United States Patent [19]

Zifferer

[11] Patent Number: 4,514,997

[45] Date of Patent: May 7, 1985

[54] TUBE CORRUGATING DIE

[75] Inventor: Lothar R. Zifferer, Waco, Tex.

[73] Assignee: Packless Metal Hose, Inc., Waco, Tex.

[21] Appl. No.: 494,615

[22] Filed: May 16, 1983

[51] Int. Cl.[3] ..... B21C 1/00; B21D 15/04

[52] U.S. Cl. ..... 72/68; 72/77; 72/367; 72/276

[58] Field of Search ..... 72/68, 77, 67, 121, 72/367, 467, 274, 276, 278, 283; 29/157.3 R

[56] References Cited

U.S. PATENT DOCUMENTS 4,377,083 3/1983 Shepherd ..... 72/77

*Primary Examiner*—Lowell A. Larson
*Attorney, Agent, or Firm*—Neal J. Mosely

[57] ABSTRACT

A novel metal tube corrugating die comprises a hollow die body with a plurality of die teeth in an internal cavity. The die teeth are flat with a curved edge extending diagonally into the die cavity providing a die corrugating tooth surface extending inward along a curved line. The die teeth are spaced uniformly around the interior of the die body. The die teeth are positioned somewhat on a helical line and are each tilted away from the other so that the planes of the individual teeth intersect substantially on the longitudinal axis of the die at a point foreward of a plane normal to the die body and passing through all of the die teeth. A mathematical equation expresses the optimum clearance between the die teeth. When a thin-walled, hollow tubing is inserted in the die, held against rotation, and the die body rotated relative to the tubing, the die teeth corrugate the tubing. Rotation of the die body corrugates and shortens the tubing according to the depth and the width of the teeth and the speed of die rotation.

16 Claims, 16 Drawing Figures

TUBE CORRUGATING DIE

BACKGROUND OF THE INVENTION

1. Field of the Invention

This invention relates to new and improved apparatus and methods for forming corrugations in metal heat exchange tubing.

2. Brief Description of the Prior Art

Finned heat exchange tubing is well known in the art for use in radiators, heat exchangers, refrigeration condensors, etc. Many types of apparatus and methods are known for the application of heat exchange fins to heat exchanger tubing.

It is also well known to form heat exchange fins integrally from the wall of heat exchange tubing members. It is also known to corrugate heat exchange tubing into longitudinally extending or circumferentially or helically extending corrugations to provide an increased surface area for heat exchange similar to the effect produced by external fins on the tubing. The production of helical corrugations and tubing, however, has in the past required the use of an internal mandrel and an external corrugation die cooperable therewith to form the desired corrugations. Such equipment has limited the length of helically corrugated tubing to the length of mandrel used in the corrugation operation. This has not been a practical method for continuous corrugation of very long thin walled heat exchange tubing.

Benson U.S. Pat. No. 2,954,212 discloses apparatus for extrusion of metal tubing with helical fins formed integrally thereon.

Slade U.S. Pat. No. 3,008,187 discloses an extrusion die for extruding thermoplastics having helical corrugations for orienting the plastic material in different directions.

Atkin U.S. Pat. No. 3,267,712 discloses an extrusion die for extruding tubing with longitudinally extending fins thereon.

Brothers U.S. Pat. No. 4,159,739 discloses a method and apparatus for forming heat exchange fins integrally from the material of heat exchange tubing.

Ford U.S. Pat. No. 3,850,227 discloses a helically corrugated heat exchange tubing and makes reference in his specification to other types of tubing and to apparatus used for forming such tubing.

Regner U.S. Pat. No. 3,988,804 discloses the use of a rotating die having helical internal fins for forming thin walled tubular cellophane film into a pleated or shirred form having helically formed pleats.

Zifferer and Shepherd U.S. Pat. No. 4,377,083 (commonly assigned) shows and a corrugating die similar to the present invention. In the manufacture of corrugating dies in accordance with that invention, it was found that the die teeth have a much smaller clearance between the inner end portions of adjacent teeth as the number of die teeth is increased. As a result of this discovery, it has been necessary to modify the die substantially when constructed with more than 4 or 5 teeth.

The prior art cited in the prosecution of U.S. Pat. No. 4,377,083 is relevant to this application but does not suggest the invention disclosed and claimed herein.

OBJECTS OF THE INVENTION

One object of this invention is to provide a new and improved rotating die for corrugating thin walled heat exchange tubing.

Another object of this invention is to provide a rotating tube corrugation die having a plurality of die teeth removably positioned therein and set at an angle to form tubular corrugations corresponding to the pitch of the die teeth.

Still another object of this invention is to provide a rotating tube corrugation die having a plurality of die teeth removably positioned therein, set at an angle to form tubular corrugations corresponding to the pitch of the die teeth, and tilted outward to optimize the clearance between the inner ends of adjacent teeth.

Other objects of this invention will become apparent from time to time throughout the specification and claims as hereinafter related.

SUMMARY OF THE INVENTION

This invention comprises a new and improved die for forming helical corrugations in metal tubing. Thin walled metal tubing is held against rotating and passed through a hollow rotating corrugating die. The corrugating die has a plurality of die teeth positioned in the internal cavity thereof and extending radially inward. The die teeth are flat in shape and have a curved surface extending inwardly. The die teeth extend diagonally relative to the axis of the die cavity at an angle corresponding to the pitch of the helical corrugation to be formed, and are tilted outward to optimize the clearance between the innermost end portions of adjacent teeth. A mathematical equation is given which expresses the optimum clearance between the die teeth.

When a thin-walled, hollow tubing is inserted into the die at the end adjacent to the roots of the die teeth and and held against rotation and the die body rotated relative to the tubing, the die teeth corrugate the tubing in somewhat the manner of a thread cutting die. Rotation of the die body causes the die teeth to corrugate the tubing to a substantial depth defined by the die teeth and shorten the tubing according to the depth and the width of the teeth and the speed of rotation of the die. The product is a helically corrugated heat exchange tubing of high heat transfer efficiency.

DESCRIPTION OF THE PREFERRED EMBODIMENTS

Figure 1:
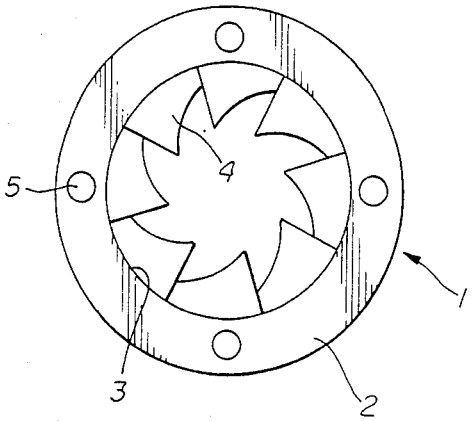
fig.1 (PRIOR ART)
FIG. 1 is an end view of one tube corrugation die representing one embodiment of the invention of U.S. Pat. No. 4,377,083 in which the die has eight corrugating teeth.
Figure 2:
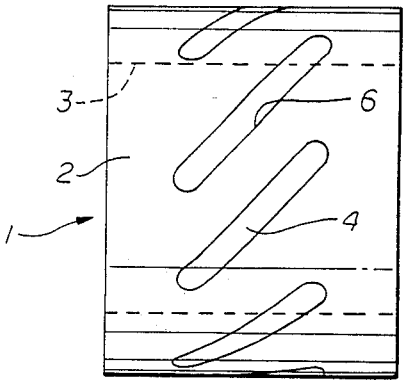
fig.2 (PRIOR ART)
FIG. 2 is a side view of the corrugating die shown in FIG. 1.
Figure 3:
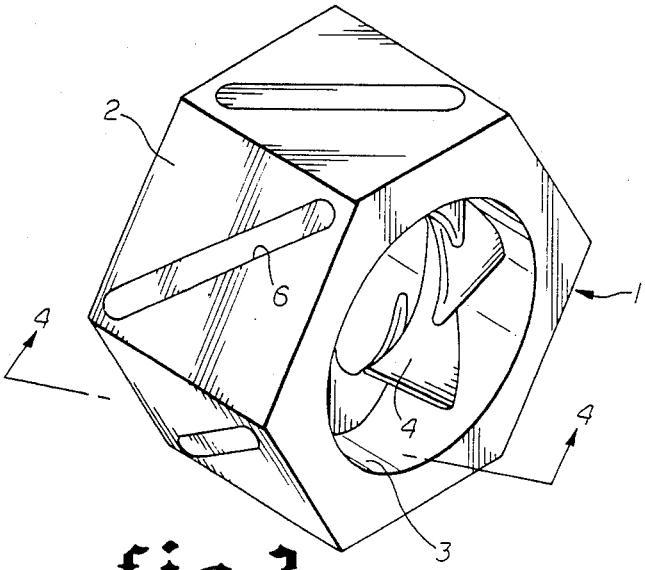
fig.3 (PRIOR ART)
FIG. 3 is an isometric view of another embodiment of the invention of U.S. Pat. No. 4,377,083 in which the die has six corrugating teeth.
Figure 4:
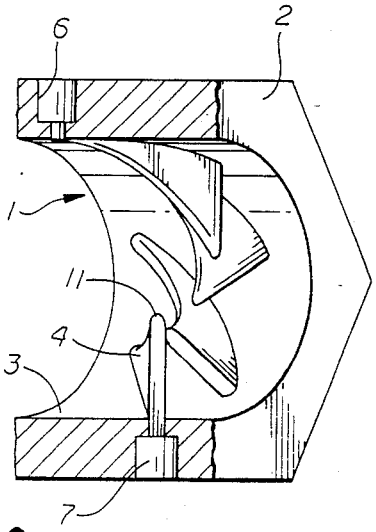
fig.4 (PRIOR ART)
FIG. 4 is a sectional view taken along the line 4—4 of FIG. 3, showing the decreasing clearance at the innermost ends of the corrugating die teeth between adjacent die teeth.

Referring to the drawing by numerals of reference and more particularly to FIGS. 1–4, there is shown a tube corrugating die 1 of the type shown in U.S. Pat. No. 4,377,083. Corrugating die 1 comprises a die body 2 which is cylindrical in shape, as shown in FIGS. 1 and 2, but could be of a regular shape such as a square, hexagonal, octagonal, etc., as shown in FIGS. 3 and 4.

Die body 1 has a cylindrical bore 3 therethrough into which protrude a plurality of die teeth 4. Die body 2 also is provided with a plurality of mounting holes or apertures 5. Die teeth 4 are positioned in flat slots 6 in die body 2 and have the tooth portion extending into the bore 3 as seen in FIGS. 3 and 4.

Figure 7:
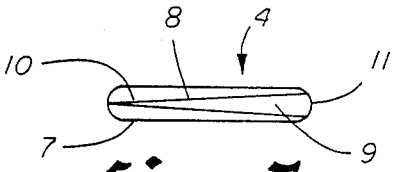
FIG. 7 is a top plan view of one of the die teeth.
Figure 8:
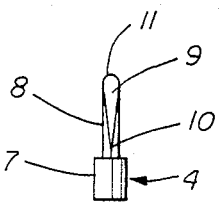
FIG. 8 is a view in left elevation of the die tooth shown in FIG. 7.
Figure 9:
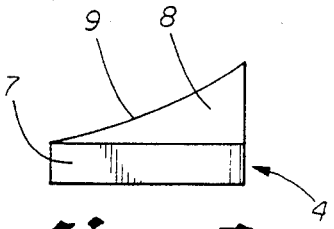
FIG. 9 is a view in front elevation of the die tooth shown in FIG. 7.
Figure 10:
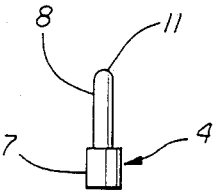
FIG. 10 is a view in right elevation of the die tooth shown in FIG. 7.

The die teeth 4 are shown in detailed FIGS. 7–10, respectively. Die teeth 4 comprise a supporting base portion 7 which is rectangular in cross section and has parallel sides which fit into slots 6 in die body 2. The tooth portion 8 of die teeth 4 is curved as indicated at 9 in FIG. 9 which is the view in front elevation of the die tooth structure. The root of the die tooth portion 8 adjacent to the supporting portion 7 is very narrow and constitutes approximately a knife edge as seen at the left of FIG. 7 and at the front of FIG. 8. The curved surface 9 of the die tooth portion 8 increases in width from knife edge 10 to a wide rounded portion 11 at the upper end of the die tooth. The shape of the die teeth is quite important in corrugating and gathering a metal tubing.

The die teeth 4 are positioned in slots 6, as shown in FIGS. 2 and 3, and lie at a substantial angle to the longitudinal axis of die body 2. As a result, die teeth 4 are positioned with root portion 10 of very narrow, almost knife edge, construction adjacent to the inner surface of bore 3. The die teeth curve along line 9 inwardly of bore 3 with the innermost projecting portion 11 projected substantially into bore 3. Die teeth 4 are all set at substantially the same angle relative to the longitudinal axis of die body 2 with the result that the curved surfaces 9 of the die teeth lie approximately on a very short partial segment of a helix. The angle of slot 6 is preferably the angle of pitch of a helix which will provide helical indentations in tubing being corrugated which are about the same width as the corrugations being produced.

When the die is constructed with a small number of die teeth, e.g. 2–5 teeth, the die teeth have a satisfactory spacing and the die operates properly. However, when the die has a larger number of teeth, e.g. 6–8, and particularly when the die teeth are of a length for drawing deep corrugations in a tubing, the innermost ends of the die teeth almost touch each other and the die is very difficult to operate. This interference at the inner end portions of the die teeth is seen most clearly in FIGS. 3 and 4.

Figure 5:
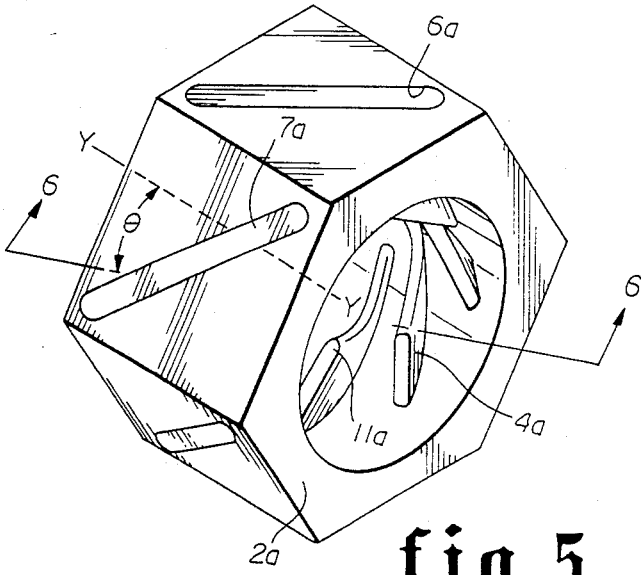
FIG. 5 is an isometric view of a preferred embodiment of this invention showing the tilting of the die teeth to optimize the clearance between adjacent die teeth at the innermost end portions thereof.
Figure 6:
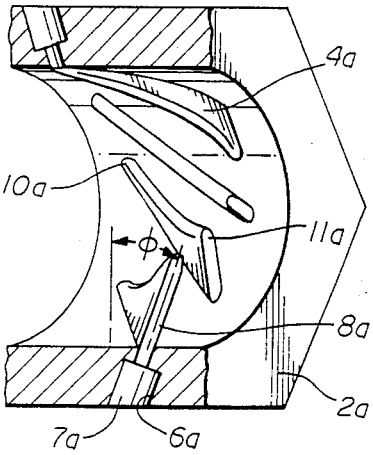
FIG. 6 is a sectional view taken on the line 6—6 of FIG. 5 showing the tilting of the die teeth and the improved clearance therebetween.

In this invention, as shown in FIGS. 5 and 6, the die teeth 4*a* are each tilted longitudinally (angle $\phi$ in FIG. 6) in the same direction so that the planes passing through the flat portions 8*a* of each of the teeth intersect substantially on the longitudinal axis of the die at a point substantially spaced from the point of intersection of a plane passing through the base portions 7*a* of the die teeth with said longitudinal axis.

As the die teeth 4*a* are successively tilted from the right angle position shown in FIG. 4 (where the teeth tend to interfere with each other), the space between the innermost end portions 11*a* of the die teeth opens up, passes through a maximum spacing, and then closes again.

The optimum spacing of the die teeth end portions 11*a* is calculated from the equation:

$$\text{Arctan } \phi = W/D \tan \theta$$

where $\phi$ is the tilt angle, as seen in FIG. 6; $\theta$ is the angle between the blade or flat portion 8*a* of the die teeth and the longitudinal axis of the die, as indicated in FIG. 5; W is the width of the blade or flat portion 8*a* (also the length of base portion 7*a*); and D is the outside diameter of a cylindrical die body 2 or the diagonal distance across a polygonal die body 2*a*. When angle $\theta$ is set at 45°, the equation reduces to: $\phi = W/D$. The optimum angle and spacing of the die blades is also dependent some what on the speed of rotation of the die in use. As will be explained later, the speed of rotation of the die has a significant effect on both the linear and diametric shrinkage of the tubing during corrugation.

When the individual die teeth 4*a* are tilted sufficiently to produce adaquate clearance between the innermost end portions 11*a* of the blade portions 8*a*, the die is operable to corrugate thin wall metal tubing which is moved therethrough by rotation of the die.

Figure 14:
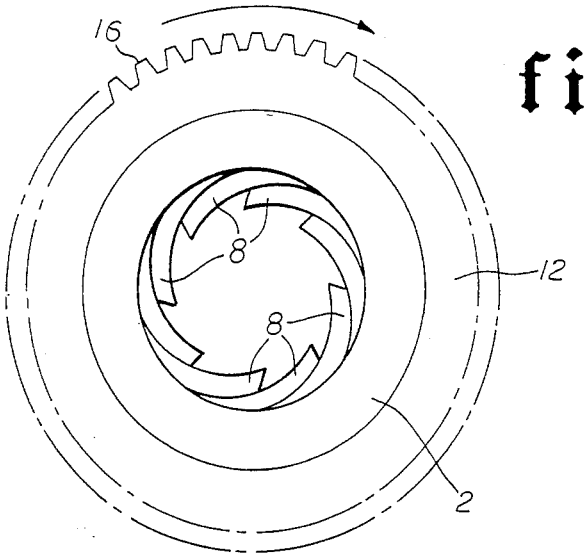
FIG. 14 is a view in left elevation of the rotating die apparatus shown in FIG. 13.
Figure 13:
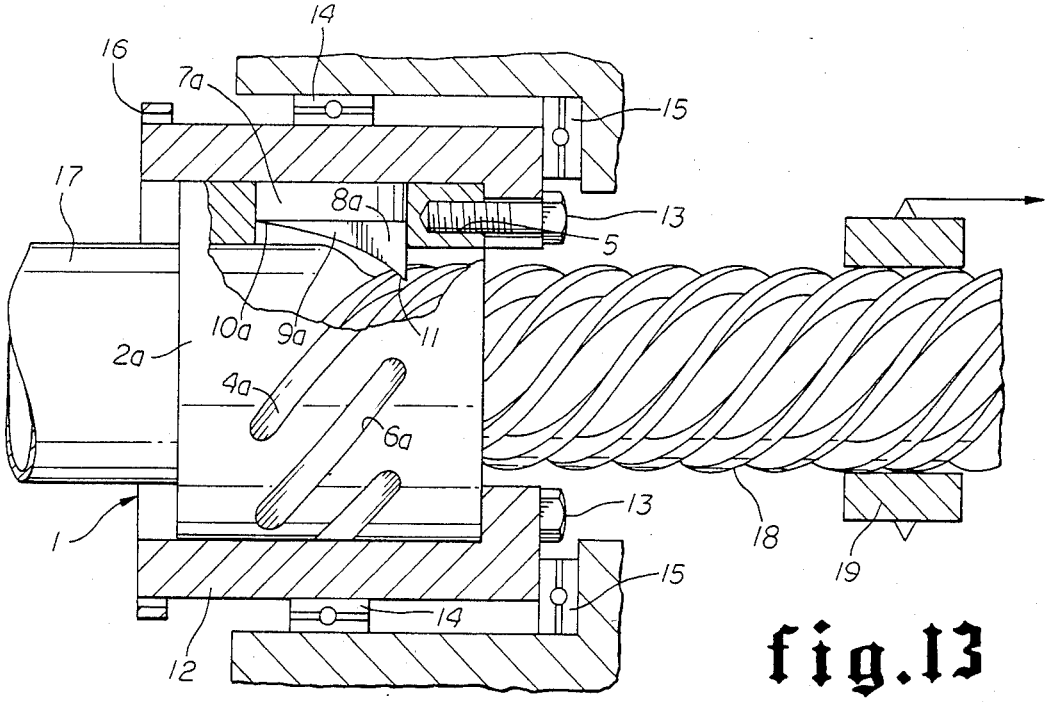
FIG. 13 is a schematic view illustrating the assembly of the rotating die shown in FIG. 5, in a tube corrugating apparatus and illustrating the progress of tubing through the die.

In FIGS. 13 and 14 corrugating die 1 is illustrated in position in appartus for producing helical corrugations and thin walled tubing. Die body 2*a* is positioned in hollow supporting block 12 and is held in place by retaining screws or bolts 13 which extend into apertures 5. Supporting body 12 has a cylindrical outer surface and is supported on bearings 14 on the outside and bearings 15 at the end surface. Die supporting body 12 is provided with a sprocket or gear 16 which may be connected to a suitable drive means (not shown) which drives a direct drive gear or a drive chain for the gear or sprocket.

The supporting structure shown in FIG. 13 is somewhat schematic and it is to understood that any suitable die support table could be used. This equipment is preferably used with a conventional draw bench and the schematic supporting structure shown in FIG. 13 refers to the supporting elements of a draw bench and any support members thereon required to support the corrugating die in a horizontal position for rotation, as shown.

A thin walled cylindrical tubing 17 is introduced into the end of die body 2*a* into the bore 3*a* adjacent the root portion 10*a* of die teeth 8*a*. Die body 2*a* is rotated by action of the drive means (not shown) on sprocket or gear 16 which causes supporting body 12 to rotate. As die body 2*a* is rotated, die teeth 8*a* grip tubing 17 and start to indent the tubing along helical lines. Die body 2*a* is rotated clockwise, as seen in FIG. 14, which causes the root portion 10*a* of each of die teeth 8*a* to engage the surface of hollow tubing 17 and progressively corrugate said surface along helical lines which are equally spaced.

As tube 17 is indented by progressive movement of curved surface 9*a* of the die teeth 8*a*, a plurality of helical corrugations are formed which correspond in number to the number of die teeth (in this embodiment, eight die teeth) and said corrugations have a pitch which is determined by the angle $\theta$ of slots 6*a* in which die teeth 8*a* are mounted. The corrugations which are produced have a depth which is determined by the height of the peak portion 11*a* of die teeth 8*a*.

The shape of die teeth 8*a* which varies from nearly a knife edge at the root portion 10*a* to a fairly wide surface 11*a* at the peaked portion of the tooth is effective to start the creasing or corrugating of tubing 17 along a relative sharp line which is progressively spread by the progressing width of die teeth 8*a* which gathers the tubing in a longitudinal direction. The width of the corrugations is determined by the spacing of the end portions 11*a* of the die teeth 8*a* which is optimized by use of the mathematical equation given above.

During rotation of die body 2*a*, tubing 17 must be restrained from rotating. The corrugated tubing 18 which emerges from the rotating die body 2*a* is corrugated with a plurality of helical corrugations which correspond in number to the number of die teeth 8 (in this embodiment, eight die teeth) and in which the width of the corrugations is about the same as the width of the grooves formed by die teeth 8*a* in making the corrugations.

After the corrugated tubing 18 emerges from the rotating die, it may be secured in clamp 19 which may be the draw block of a draw bench and movable along the surface of the bench (not shown). The clamp or draw block 19 is effective to prevent tubing 17 and corrugated tubing 18 from rotating during the corrugating of the tubing by rotation of die body 2*a*. While the body of the tubing, as whole, is restrained from rotation during corrugation, the metal of the tubing is twisted by the corrugation process and turns noticably as the process reaches completion.

The rotation of die body 2*a* may be effected by a positive drive operating on gear or sprocket 16 which rotates supporting body 12. When operated in this manner, it is possible to corrugate indefinite lengths of thin walled hollow tubing. For example, it is theoretically possible to feed great lengths of hollow tubing directly from a supporting spool and corrugate the tubing continuously. In most cases, however, the tubing is corrugated in preselected lengths which are determined by the use to which the tubing is to be put. Since the tubing is corrugated in this manner for use in heat exchange applications, it is preferred to have at least one end portion free from corrugations (the end which first passes through the die) which facilitates handling the corrugated tubing and securing it in a heat exchanger.

Figure 16:
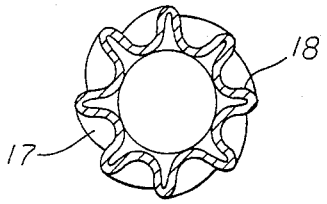
FIG. 16 is an end view of the corrugated portion of the tubing shown in FIG. 15.
Figure 15:
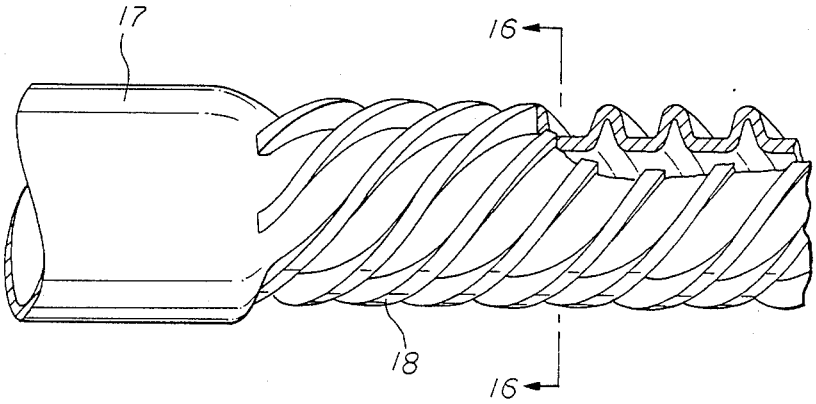
FIG. 15 is a view in elevation, and partly in broken section, of a piece of thin walled tubing which has been partially corrugated using the apparatus and method of the invention.

In the embodiment shown in FIGS. 5–6 and in the apparatus shown in FIGS. 13–14, the tubing produced has eight helical corrugations of very substantial pitch and depth. Details of this tubing are shown more clearly in FIG. 14 wherein part of the wall of the corrugated tubing portion 18 is broken away to show the corrugations. Also, in FIG. 16, an end view of the corrugated tubing is shown.

Corrugating die 1 is quite versatile in design. The die teeth 4*a* may be varied in shaped and the extent of protrusion of the individual die tooth portion 8*a* may be varied to produce a desired depth of corrugation in the tubing being corrugated. Likewise, the width of the upper portion 11*a* of die tooth portion 8*a* may be varied in size to vary the amount of gather of the tubing in forming the corrugations.

The angle $\theta$ of slots 6*a* in die body 2*a* may likewise be varied to set the pitch of the helical corrugations at any desired value. The number of die teeth 4*a* used in corrugating die 1 may be varied in accordance with the number of corrugations desired. It is usually preferred to have dies with six or eight teeth. However the number of the die teeth may vary from two or three up to a very substantial number so long as the teeth are tilted through angle $\phi$ a sufficient distance to maintain adaquate spacing. As noted above the optimum spacing of the innermost end portions of the die teeth can be determined with mathematical precision.

Figure 11:
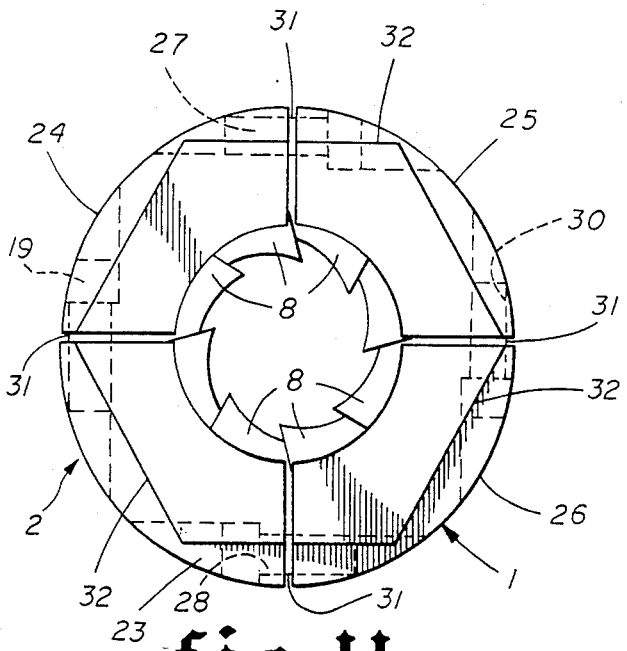
FIG. 11 is an end view of a rotating die, similar to FIG. 5, in which the die body is formed of four separate segments.
Figure 12:
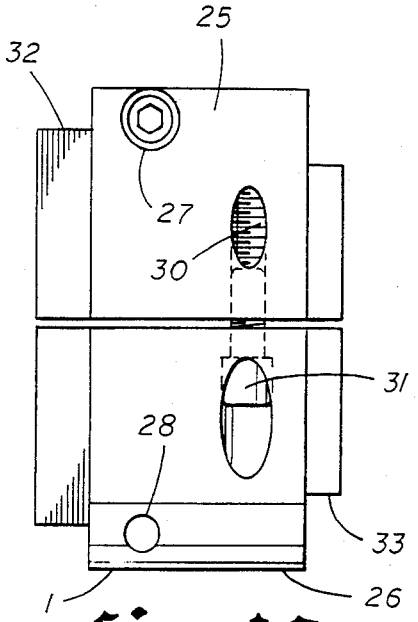
FIG. 12 is a side view of the die shown in FIG. 11.

In the embodiment previously described in FIGS. 5 and 6, die body 2*a* has been of a unitary construction and die teeth 4*a* have been inserted into die body 2*a* through slots 6*a* extending from the outer surface of die body 2*a* into inner bore 3*a* thereof. In FIGS. 11–12, there is shown a further embodiment of the invention shown in U.S. Pat. No. 4,377,083, in which die body 2*a* is segmented and the die teeth are inserted into slots adjacent to the bore when the segments are disassembled. This segmented construction can be used in the present invention so long as the necessary angle of tilt is maintained for the die teeth.

In FIG. 11, corrugating die 1 is shown to have a die body 2*a* having internal bore 3*a* with die teeth portions 8*a* extending into said bore. Die body 2*a* is formed of four body segments 23, 24, 25, and 26. These segments have apertures or passages 27, 28, 29, and 30. Screws or bolts 31 are positioned in the respective apertures or passages 27–30 to secure the die body segments together as shown in FIGS. 11 and 12. Die body 2*a* has a plurality of flats 32 cut in the surface thereof to define a hexagonal shape in one end portion. At the other end of die body 2*a* there is provided a cylindrical extension 33 of reduced diameter.

In this embodiment of the invention, the corrugating die 1, when assembled, does not require an external supporting block 12 to secure the die teeth against radial displacement during operation. In this embodiment, the die teeth are supported rigidly in slots 34 and cannot move radially outward. This segmented die, when assembled, may be used directly in corrugating the thin walled tubing 17 without the need for a supporting die body.

From the foregoing description, it is seen that the novel corrugating die 1 may be of a unitary die body construction or may be formed of segments which are assembled, as in FIGS. 11–12. Any desired number of die teeth 4*a* may be used according to the number of helical corrugations desired. When a small number of die teeth are used, e.g. two to five, the tilt angle at which the die teeth must be set in die body 2*a* to produce equally spaced corrugation is not very great. When a greater number of die teeth are used, the tilt angle at which the die teeth are set in the die body is important to permit adaquate clearance of the die teeth so that the tubing will not be unduly squeezed during the corrugation process.

The number of corrugations may be varied according to the number of die teeth used. The pitch of the helical corrugations may be varied according to the angle $\theta$ at which the die teeth are set and the speed of rotation of the die. The depth and width of the corrugations are determined partially by the angle $\theta$ of setting of the die teeth and partially by the width of the die teeth, and particularly the variation in width from the root portion 10*a* to the protruding portion 11*a*. The depth of the corrugation is largely determined by the extent of protrusion of the innermost portion 11*a* of the die teeth. The tilt angle $\phi$, as previously noted, determines whether there is adaquate clearance between the die teeth for the die to function in a satisfactory manner.

The unusual design and flexibility available in this apparatus and process lies in the ability to control by means of the number of blades and the RPM of the die the ratio of the flow area outside a corrugated tube in a heat exchanger to the flow area inside the tube. This further controls the pressure drops of the counterflowing fluids in coaxial heat exchangers.

The helical angle of the corrugated tubing taken from the axis of the tubing is measured by the formula $$\tan^{-1}\phi' = (\pi D/P)$$

where D is the diameter of the tubing and P is the pitch.

The angle $\phi$ of the blades in relation to longitudinal axis accomodates a variety of helical angles in the product corrugated tubing which are determined by the number of blades and the RPM of the powered rotating head. The $\theta$ angle of the blade complements the helical angle achieved by adjusting the RPM. The closer that $\theta$ agrees with $\phi'$, the more uniform the shape of the helical convolutions and the less the wear on the blades.

Diametric shrink from 25–45% is concurrent with linear shrink of 8–20% of the starting dimensions of the tubing during corrugation. A 45° blade angle (angle $\theta$) with a tilt (angle $\phi$) of 12°–22°, depending on die diameter and blade width, will produce a variety of corrugated tube diameters and corrugation pitch, depending on the RPM of the die. For example, a 1.500″ diameter was run through a six-blade die at several differend rotational speeds. At a die rotation of 385 RPM, the corrugated tube product had a diameter of 1.130″ and a helical pitch of 2.75. At a die rotation of 250 RPM, the finished diameter was 1.250″ and the pitch was 4.25. When the RPM of the die was reduced to 175, the finished diameter of the corrugated tube was 1.330″ and the pitch was 6.25. It is apparent from these runs that increasing die RPM reduces both diameter and pitch and vice versa.

The product of any of the embodiments of the corrugating die is a tubing having a plurality of corrugations, corresponding to the number of die teeth, which provides a greatly incrased surface area for heat exchange purposes. Such tubing has a high heat transfer surface while maintaining a relatively large internal cross sectional area for flow of a heat exchange fluid through the tubing.

While this invention has been fully and completely described with special emphasis upon a preferred embodiment, it should be understood that within the scope of the appended claims the invention may be practiced otherwise than as specifically described herein.

I claim:

1. A metal tube corrugating die for corrugating tubing without a supporting mandrel comprising a hollow die body with a longitudinally extending bore, a plurality of die teeth supported in said die body equidistantly around the circumference of and extending into said bore, each having a base portion supported in said die body at an angle to the longitudinal axis thereof, a corrugating die portion comprising a flat planar plate extending from said base portion having an edge curving from a root portion adjacent to the surface of said bore to a peak portion radially inward therefrom and an arcuate length of a small fraction of one helical coil of the tubing corrugated therein, each die tooth being uniformly tilted outward at an angle such that the planes of said plates intersect on the longitudinal axis of the die at a point spaced from the intersection of said axis with a plane normal to said axis and passing through the base portions of said die teeth, the angle and spacing of said die teeth being such that multiple uniform helical corrugations in thin walled tubing are produced by passing such tubing therethrough while rotating said die, and said tilt angle of said die teeth determining the spacing of the innermost points of said flat planar plates.

2. A metal tube corrugating die according to claim 1 in which each of said die teeth has said curved surface of varying width from a narrow relatively sharp edge at said root portion widening gradually to a wide portion at the peak portion thereof.

3. A metal tube corrugating die according to claim 2 in which said die tooth tilt angle is such that the peak portion of each die tooth has substantially the maximum spacing in relation to the next adjacent die tooth and the spacing between said die tooth peak portions is uniform.

4. A metal tube corrugating die according to claim 2 in which said die body is of cylindrical or of regular polygonal shape, said die tooth tilt angle is such that the peak portion of each die tooth has substantially the maximum spacing in relation to the next adjacent die tooth and the spacing between said die tooth peak portions is uniform, and said maximum spacing occurs at a tilt angle expressed in the mathematical equation:

$$\text{Arctan}\ \phi = W/D \tan\theta$$

where $\phi$ is the tilt angle of each of the die teeth measured from a line passing diametrically through the die body at the base portion of one of the die teeth; $\theta$ is the angle between the corrugating portion of each of the die teeth and the longitudinal axis of the die; W is the width of the flat planar plate portion of each of the die teeth; and D is the outside diameter of a cylindrical die body or the diagonal distance across a regular polygonal die body.

5. A metal tube corrugating die according to claim 2 in which said die body is of cylindrical or of regular polygonal shape, said die tooth angle relative to the longitudinal axis of the die body is 45°, and said die tooth tilt angle is such that the peak portion of each die tooth has substantially the maximum spacing in relation to the next adjacent die tooth and the spacing between said die tooth peak portions is uniform, said maximum spacing occurring at a tilt angle expressed in the mathematical equation:

$$\text{Arctan } \phi = W/D\theta$$

where $\phi$ is the tilt angle of each of the die teeth measured from a line passing diametrically through the die body at the base portion of one of the die teeth; $\theta$ is the angle between the corrugating portion of each of the die teeth and the longitudinal axis of the die; W is the width of the flat planar plate portion of each of the die teeth; and D is the outside diameter of a cylindrical die body or the diagonal distance across a regular polygonal die body.

6. A metal tube corrugating die according to claim 1 in which said die body includes a plurality of inwardly extending slots each of which is rectangular in cross section, opening into said bore to support the base portion of a die tooth therein with said plate portion extending into said bore at a selected tilt angle sufficient to maintain adaquate spacing of the peak portions of each of said die teeth.

7. A metal tube corrugating die according to claim 6 in which said die tooth tilt angle is such that the peak portion of each die tooth has substantially the maximum spacing in relation to the next adjacent die tooth and the spacing between said die tooth peak portions is uniform.

8. A metal tube corrugating die according to claim 6 in which said die body is of cylindrical or of regular polygonal shape, said die tooth tilt angle is such that the peak portion of each die tooth has substantially the maximum spacing in relation to the next adjacent die tooth and the spacing between said die tooth peak portions is uniform, and said maximum spacing occurs at a tilt angle expressed in the mathematical equation:

$$\text{Arctan } \phi = W/D \tan \theta$$

where $\phi$ is the tilt angle of each of the die teeth measured from a line passing diametrically through the die body at the base portion of one of the die teeth; $\theta$ is the angle between the corrugating portion of each of the die teeth and the longitudinal axis of the die; W is the width of the flat planar plate portion of each of the die teeth; and D is the outside diameter of a cylindrical die body or the diagonal distance across a regular polygonal die body.

9. A metal tube corrugating die according to claim 6 in which said die body is of cylindrical or of regular polygonal shape, said die tooth angle relative to the longitudinal axis of the die body is 45°, and said die tooth tilt angle is such that the peak portion of each die tooth has substantially the maximum spacing in relation to the next adjacent die tooth and the spacing between said die tooth peak portions is uniform, said maximum spacing occurring at a tilt angle expressed in the mathematical equation:

$$\text{Arctan } \phi = W/D\theta$$

where $\phi$ is the tilt angle of each of the die teeth measured from a line passing diametrically through the die body at the base portion of one of the die teeth; $\theta$ is the angle between the corrugating portion of each of the die teeth and the longitudinal axis of the die; W is the width of the flat planar plate portion of each of the die teeth; and D is the outside diameter of a cylindrical die body or the diagonal distance across a regular polygonal die body.

10. A metal tube corrugating die according to claim 1 in which said die body comprises a plurality of segments releasably secured together, and each of said die body segments having a slot extending along the surface of said bore at an angle to the longitudinal axis thereof and at a tilt angle sufficient to support said die tooth base portion with said corrugating die portion extending into said bore with adaquate spacing between the peak portions of each of said die teeth.

11. A metal tube corrugating die according to claim 10 in which said die tooth tilt angle is such that the peak portion of each die tooth has substantially the maximum spacing in relation to the next adjacent die tooth and the spacing between said die tooth peak portions is uniform.

12. A metal tube corrugating die according to claim 10 in which said die body is of cylindrical or of regular polygonal shape, said die tooth tilt angle is such that the peak portion of each die tooth has substantially the maximum spacing in relation to the next adjacent die tooth and the spacing between said die tooth peak portions is uniform, and said maximum spacing occurs at a tilt angle expressed in the mathematical equation:

$$\text{Arctan } \phi = W/D \tan \theta$$

where $\phi$ is the tilt angle of each of the die teeth measured from a line passing diametrically through the die body at the base portion of one of the die teeth; $\theta$ is the angle between the corrugating portion of each of the die teeth and the longitudinal axis of the die; W is the width of the flat planar plate portion of each of the die teeth; and D is the outside diameter of a cylindrical die body or the diagonal distance across a regular polygonal die body.

13. A metal tube corrugating die according to claim 10 in which said die body is of cylindrical or of regular polygonal shape, said die tooth angle relative to the longitudinal axis of the die body is 45°, and said die tooth tilt angle is such that the peak portion of each die tooth has substantially the maximum spacing in relation to the next adjacent die tooth and the spacing between said die tooth peak portions is uniform, said maximum spacing occurring at a tilt angle expressed in the mathematical equation:

$$\text{Arctan } \phi = W/D\theta$$

where $\phi$ is the tilt angle of each of the die teeth measured from a line passing diametrically through the die body at the base portion of one of the die teeth; $\theta$ is the angle between the corrugating portion of each of the die teeth and the longitudinal axis of the die; W is the width of the flat planar plate portion of each of the die teeth; and D is the outside diameter of a cylindrical die body or the diagonal distance across a regular polygonal die body.

14. A metal tube corrugating die according to claim 1 in which said die tooth tilt angle is such that the peak portion of each die tooth has substantially the maximum spacing in relation to the next adjacent die tooth and the spacing between said die tooth peak portions is uniform.

15. A metal tube corrugating die according to claim 1 in which said die body is of cylindrical or of regular polygonal shape, said die tooth tilt angle is such that the peak portion of each die tooth has substantially the maximum spacing in relation to the next adjacent die tooth and the spacing between said die tooth peak portions is uniform, and said maximum spacing occurs at a tilt angle expressed in the mathematical equation:

$$\text{Arctan } \phi = W/D \tan \theta$$

where $\phi$ is the tilt angle of each of the die teeth measured from a line passing diametrically through the die body at the base portion of one of the die teeth; $\theta$ is the angle between the corrugating portion of each of the die teeth and the longitudinal axis of the die; W is the width of the flat planar plate portion of each of the die teeth; and D is the outside diameter of a cylindrical die body or the diagonal distance across a regular polygonal die body.

16. A metal tube corrugating die according to claim 1 in which said die body is of cylindrical or of regular polygonal shape, said die tooth angle relative to the longitudinal axis of the die body is 45°, and said die tooth tilt angle is such that the peak portion of each die tooth has substantially the maximum spacing in relation to the next adjacent die tooth and the spacing between said die tooth peak portions is uniform, said maximum spacing occurring at a tilt angle expressed in the mathematical equation:

$$\text{Arctan } \phi = W/D\theta$$

where $\phi$ is the tilt angle of each of the die teeth measured from a line passing diametrically through the die body at the base portion of one of the die teeth; $\theta$ is the angle between the corrugating portion of each of the die teeth and the longitudinal axis of the die; W is the width of the flat planar plate portion of each of the die teeth; and D is the outside diameter of a cylindrical die body or the diagonal distance across a regular polygonal die body.

* * * * *